US008544308B2

(12) United States Patent
Hartung

(10) Patent No.: US 8,544,308 B2
(45) Date of Patent: Oct. 1, 2013

(54) ROLL STAND

(75) Inventor: Hans-Georg Hartung, Pulheim (DE)

(73) Assignee: SMS Siemag AG, Duesseldorf (DE)

( * ) Notice: Subject to any disclaimer, the term of this patent is extended or adjusted under 35 U.S.C. 154(b) by 0 days.

(21) Appl. No.: 12/600,867

(22) PCT Filed: Mar. 16, 2009

(86) PCT No.: PCT/EP2009/001911
§ 371 (c)(1),
(2), (4) Date: Dec. 1, 2009

(87) PCT Pub. No.: WO2009/118117
PCT Pub. Date: Oct. 1, 2009

(65) Prior Publication Data

US 2011/0232350 A1 Sep. 29, 2011

(30) Foreign Application Priority Data

Mar. 27, 2008 (DE) ..... 10 2008 015 826

(51) Int. Cl.

| | |
|---|---|
| ***B21B 31/00*** | (2006.01) |
| ***B21B 31/07*** | (2006.01) |
| ***B21B 31/32*** | (2006.01) |
| ***B21B 13/14*** | (2006.01) |
| ***B21B 29/00*** | (2006.01) |

(52) U.S. Cl.
USPC ..... 72/237; 72/245; 72/241.2; 72/241.8

(58) Field of Classification Search
USPC ..... 72/241.2, 237, 247, 246, 245, 241.4, 72/241.8
See application file for complete search history.

(56) References Cited

U.S. PATENT DOCUMENTS

| | | | | |
|---|---|---|---|---|
| 1,860,931 | A | 5/1932 | Keller | |
| 3,426,567 | A | 2/1969 | Smith | 72/240 |
| 3,442,109 | A | 5/1969 | Diolot | 72/240 |
| 3,621,695 | A * | 11/1971 | Eibe et al. | 72/237 |
| 3,626,739 | A * | 12/1971 | Willeke et al. | 72/245 |
| 3,645,122 | A * | 2/1972 | Harlow | 72/237 |
| 3,818,743 | A | 6/1974 | Kajiwara et al. | 72/243 |

(Continued)

FOREIGN PATENT DOCUMENTS

| | | |
|---|---|---|
| DE | 1652557 | 4/1971 |
| DE | 2034490 | 1/1972 |
| DE | 2428823 | 1/1976 |
| JP | 61140313 A | 6/1986 |

*Primary Examiner* — Dana Ross
*Assistant Examiner* — Mohammad I Yusuf
(74) *Attorney, Agent, or Firm* — Andrew Wilford

(57) ABSTRACT

The invention relates to a roll stand comprising at least one roll (1) having a rotation axis (a), said roll being supported in two installed parts (2, 3) disposed in the axial end regions of the roll (1) and each having a center plane (M), wherein the roll (1) can be positioned in the direction perpendicular to the transport direction (F) of the product to be rolled by means of at least one positioning element (4). In order to be able to introduce a bending moment acting counter to the roll bending moment into the roller in a simple manner and without additional elements, according to the invention, each installed part (2, 3) is connected to a bending lever (5, 6) and the positioning element (4) is disposed such that the positioning force thereof is introduced into the bending lever (5, 6) at a location (G) removed from the center plane (M) of the installed part (2, 3), and thereby into the installed part (2, 3).

6 Claims, 5 Drawing Sheets

(56) References Cited

U.S. PATENT DOCUMENTS 4,320,643 A 3/1982 Yasuda et al. ..... 72/8
7,021,104 B2 * 4/2006 Drigani et al. ..... 72/241.2
7,895,871 B2 * 3/2011 Zieser et al. ..... 72/245
2009/0100891 A1 4/2009 Hohenbichler et al. ..... 72/241.8

* cited by examiner

ROLL STAND

CROSS REFERENCE TO RELATED APPLICATIONS

This application is the US national phase of PCT application PCT/EP2009/001911, filed 16 Mar. 2009, published 1 Oct. 2009 as WO 2009/118,117, and claiming the priority of German patent application 102008015826.7 itself filed 27 Mar. 2008, whose entire disclosures are herewith incorporated by reference.

FIELD OF THE INVENTION

The invention relates to a roll stand comprising a roll having a rotation axis and mounted in two chocks that are provided at the axial ends of the roll and that each have a center plane, the roll along with at least one actuator element being shiftable in a direction perpendicular to the travel direction of the workpiece.

BACKGROUND OF THE INVENTION

In the process of rolling a metallic workpiece, critical importance is attached to the most precise possible adjustment and maintenance of the roll gap since the final shape of the workpiece is determined thereby. At the same time, the rolling forces deflect the rolls, a factor that applies to the work rolls as well as to the intermediate and backup rolls of a roll stand. One of the classical problems in rolling flat steel is thus the roll-force-induced deflection of the set of rolls, which problem results in a greater or lesser deviation of the roll gap shape from the ideal form determined by the strip profile, and thus in deviations in flatness. A variety of solutions based on various principles have been developed to compensate for this.

DE 24 28 823 employs a spindle system that can bend the two roll chocks by displacing the spindles in two downwardly concave guide shells. This causes a bending moment to be introduced that counteracts the bending moment created by the deflection of the roll.

In DE 20 34 490, auxiliary piston-cylinder units positioned outside the center plane of the chocks are also employed that apply a bending or tilting moment to the chocks that counteracts the bending of the roll.

In DE 15 27 662 a toggle-lever-type rod arrangement is used to exert an bending moment on the two chocks of the roll, which moment again counteracts the bending moment by which the roll is bent due to the rolling force.

Axially displaceable intermediate rolls with a non-cylindrical outer surface are employed in the solution provided by DE 30 00 187 and DE 22 06 912.

Another solution using mechanical counter-bending is known from U.S. Pat. No. 1,860,931.

Currently employed rolling mills generally have at least one bending system for the work rolls, often for the intermediate rolls as well in the case of the six-high roll stand. The principle being applied is based here on introducing transverse and bending forces, and thus bending moments, into the relevant rolls. The effect, however, is generally not sufficient to compensate for the various deflection states in a rolling mill due to varying rigidity and width of the workpiece. As a result, various camber-ground rolls are used, or roll-displacement systems are provided in addition. These axial-displacement systems operate either on the principle of internal load displacement or of the modifiable equivalent crown of two rollers (so-called continuous variable crown—CVC system).

The use of variably crowned rolls is cumbersome. Displacement systems are also expensive, and, particularly in response to load displacement, result in unwanted twisting of the stand. An analogous situation applies to principles that operate using slightly skewed rolls.

The common factor in all the previously known solutions is that special apparatus elements must be used to superimpose a counter-bending moment on the roll-force-induced deflection of the (work) roll. The previously known solutions are accordingly expensive and in part difficult in terms of implementation.

OBJECT OF THE INVENTION

The object of this invention is to further develop a roll stand of the type described above so as to enable a bending moment counteracting the roll bending moment to be introduced into the roll in a simpler and less costly manner and using as few elements as possible. The goal is thus to be able to eliminate costly mechanisms, while at the same time ensuring that abnormal deflections of the roll resulting from the roll forces can be compensated as well as possible.

SUMMARY OF THE INVENTION

The solution to this problem provided by the invention is characterized in that each chock is connected to a bending lever and the actuator is positioned such that its force is applied to the bending lever at a location offset from the center plane of the chock, then through this lever to the chock.

It is possible here for only a single actuator to be used that is provided centrally between the chocks. In this case, provision can be made whereby the actuator acts on a traverse that is connected by two joints to respective bending levers.

Alternatively, provision can also be made whereby two actuators are arranged mirror symmetrical to a center plane of the roll. These actuators can each be connected to one bending lever a respective joint. The two joints here can be interconnected by a traverse.

The at least one actuator is preferably a hydraulic piston-cylinder unit. The actuator(s) can be supported on a fixed crossbeam of the roll stand.

In a constructively advantageous solution, provision is made whereby the roll together with chocks and bending levers is displaceable in a direction perpendicular to the travel direction of the rolled stock through the roll stand between two side walls of the roll stand. The bending levers here can laterally surround the chocks and form a sliding surface for the side walls.

Means can be provided between the bending levers and the chocks for applying torque from the bending lever to the chock. In a preferred embodiment of the invention, this involves interfitting ridge and groove formations extending toward the rotation axis of the roll.

The rolls referenced here can be work rolls in the case of two-high stands, or backup rolls.

The proposed solution is thus aimed at largely preventing the rolling-force-induced deflections of the roll stand, and the associated imperfections in the roll gap shape, by an approach such that bending moments are built up on the rolls (in particular, the backup rolls and work rolls) by the rolling force itself, the bending effect of which is opposed to the rolling-force-induced deflection of the rolls.

This invention is thus based on a basic stand that prevents the unwanted roll-force-induced roll deformations to a large extent and essentially independently of the rolling force, and thus has the potential to succeed with a minimum amount of active flatness-control systems.

It is also possible nevertheless to combine the proposal according to the invention with all of the previously known control systems.

BRIEF DESCRIPTION OF THE DRAWING

Embodiments of the invention are illustrated in the drawing. Therein.

DETAILED DESCRIPTION

Figure 1:
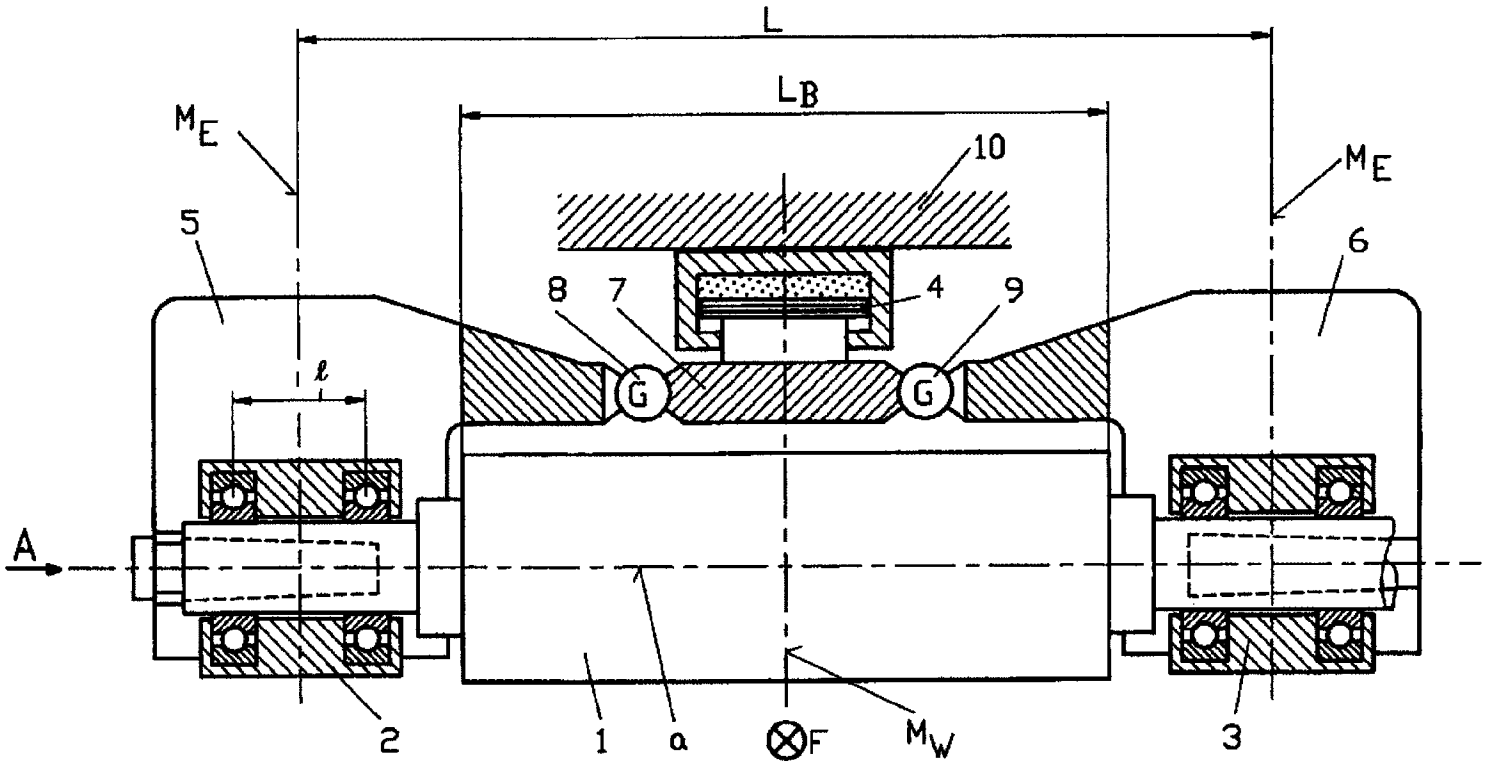
FIG. 1 schematically illustrates a work roll together with both chocks and a bending bridge where the roll is shifted downward by an actuator, as viewed in the travel direction of the rolled stock.
Figure 3:
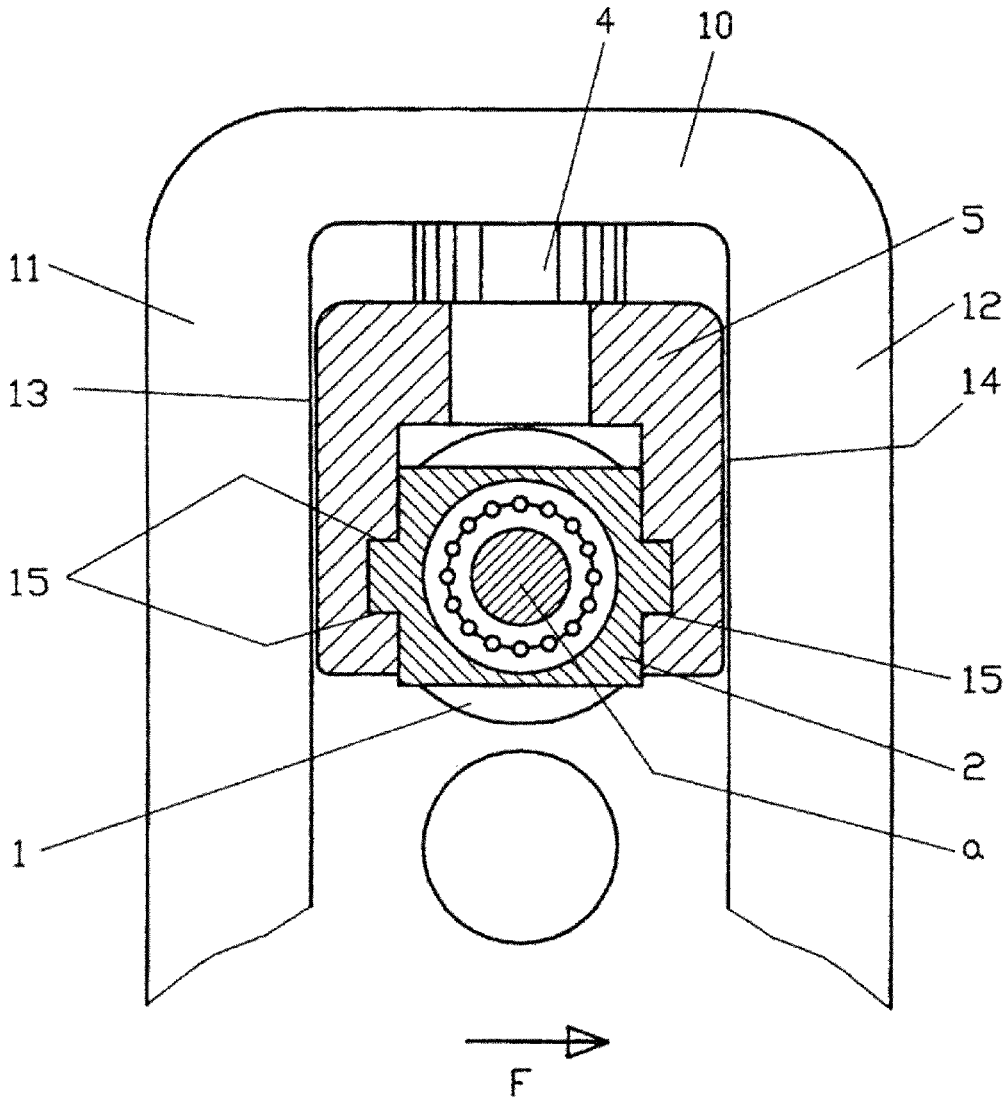
FIG. 3 shows the apparatus of FIG. 1 as viewed from direction A in FIG. 1.

FIG. 1 shows a section of a roll stand that has a work roll 1 having one rotation axis a that is supported in the standard manner in two chocks 2 and 3. The work roll 1 rolls a workpiece, not shown, that is rolled as shown in FIG. 3 in a travel direction F (perpendicular to the plane of projection). The work roll 1 is pressed by means of a hydraulic actuator 4 against the workpiece. Due to the contact with the workpiece, a counter-bending moment is superimposed on the deflection of the roll 1, which moment is generated by two bending levers 5 and 6. The two bending levers 5, 6 are attached to the chocks 2, 3 in a torsionally rigid manner. In the center region of the apparatus, they are connected at two pivots G by means of two joints 8 and 9 to a traverse 7 on which the actuator 4 acts. The actuator 4 rests on a cross beam 10 of the roll stand.

The roll length is denoted by $L_B$ and is smaller than the spacing L of the center planes $M_E$ of the two chocks 2, 3. Also provided is the spacing l of two rolling-element bearings that are carried in the chocks 2, 3 and support the roll necks. The overall arrangement is symmetrical, i.e. mirror-symmetrically flanking the center plane $M_W$ of the roll 1.

Figure 2:
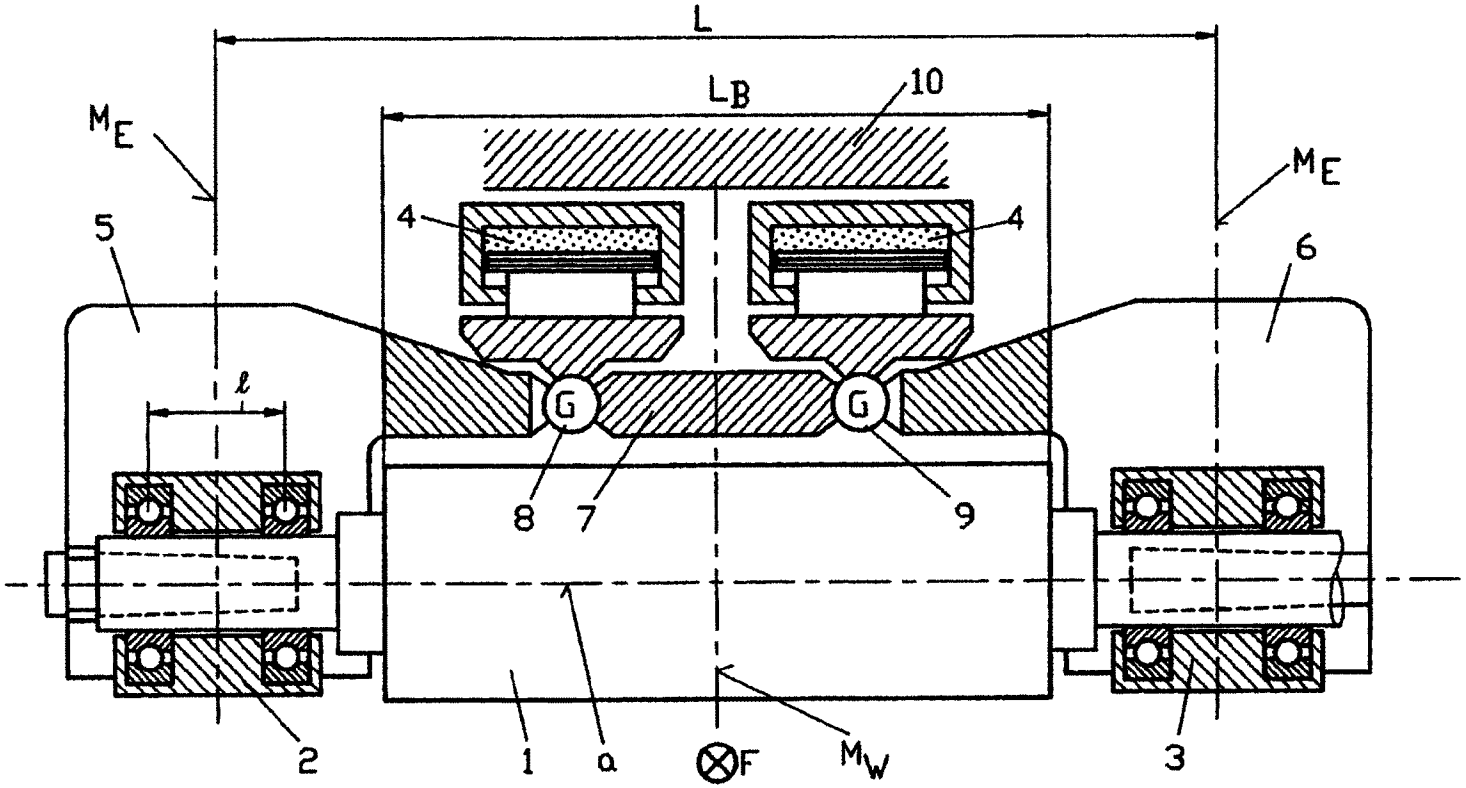
FIG. 2 shows an alternative embodiment, relative to FIG. 1, of the apparatus with two actuators.

The solution of FIG. 2 differs from that of FIG. 1 only in that here two actuators 4 are used. Otherwise the description for FIG. 1 applies analogously.

FIG. 3 shows the view A from FIG. 1 illustrating how the roll 1, together with the chocks 2, 3 and the bending levers 5, 6, is displaceable vertically within the roll stand. To this end, the roll stand has two side walls 11 and 12 that have sliding surfaces 13 and 14, thereby enabling the bending levers 5, 6 to slide up and down vertically on them. What must also be mentioned is means 15—here in the form of a ridge/groove formation—by which a bending moment can be applied by the bending levers 5, 6 to the respective chocks 2, 3.

Ideally, a stand loaded by a rolling-force distribution would be adjusted in the same way—at the center and width-wise—as the workpiece acting on the work roll. However, a rotating roll can not be adjusted centrally by one or more stationary actuator cylinders—the location of the introduction of a rolling force can only be the chock with the roll bearing.

The goal of this invention is to utilize the fundamental principle of the ideal application of rolling force, specifically along the roll outer surface. The roll, which is both loaded and adjusted in same way, does not experience any bending moment—neither locally nor as a whole. The roll axis remains straight. The fact that the rolling force can be applied only to the chocks and not to the roll outer surface means that a compensating reverse-bending moment cannot be introduced into the roll locally but also only at the chock. In order to generate this reverse-bending moment, the actuator cylinder does not bear centrally on the chocks or roll bearings but instead at an appropriate spacing. The resulting moment must be introduced into the chock by a sufficiently rigid mechanism.

FIG. 1 shows such an arrangement comprising a central actuator cylinder. The force can also be applied by multiple cylinders, however, as is illustrated in FIG. 2 with two actuator cylinders. The essential aspect is that an appropriate spacing is provided between the load contact point and the chock and that the connection of the bending lever to the chock is able to transfer a moment.

In terms of constructive design, the combination of chock and bending lever must be designed so that the chock does not become wedged in the housing window and as a consequence cannot be moved to effect adjustment. In addition, the exchangeability of the backup roll must be ensured. The displaceability of the roll can be achieved, for example, in that the side walls of the bending lever comprise the outsides of the chock and movement is between the side walls and the rolling mill housing, as seen in FIG. 3.

Ideally, the chock is designed such that the compensating reverse-bending moment is applied to the chock by a force couple superimposed on the other forces, the lines of action of the force couple approximately matching the positions of the radial rolling-element bearings so as largely to prevent moment loads on the rolling-element bearings. The actuator cylinder applies a load, on the one hand, on the force-transmitting bridge, composed of the two bending levers (together with the traverse), and, on the other hand, it is supported by the cross beam of the rolling mill. The same principle can also be utilized for the non-actively-adjusted and generally lower roll set, where the actuator cylinder can be replaced by a pass-line adjustment or simply by a fixed pressure piece. At least in the case of a central actuator cylinder, swiveling the stand can preferably be effected by an appropriately equipped balancing cylinder. Given the smaller hysteresis of these small cylinders, this also brings about more precise swiveling.

Figure 4:
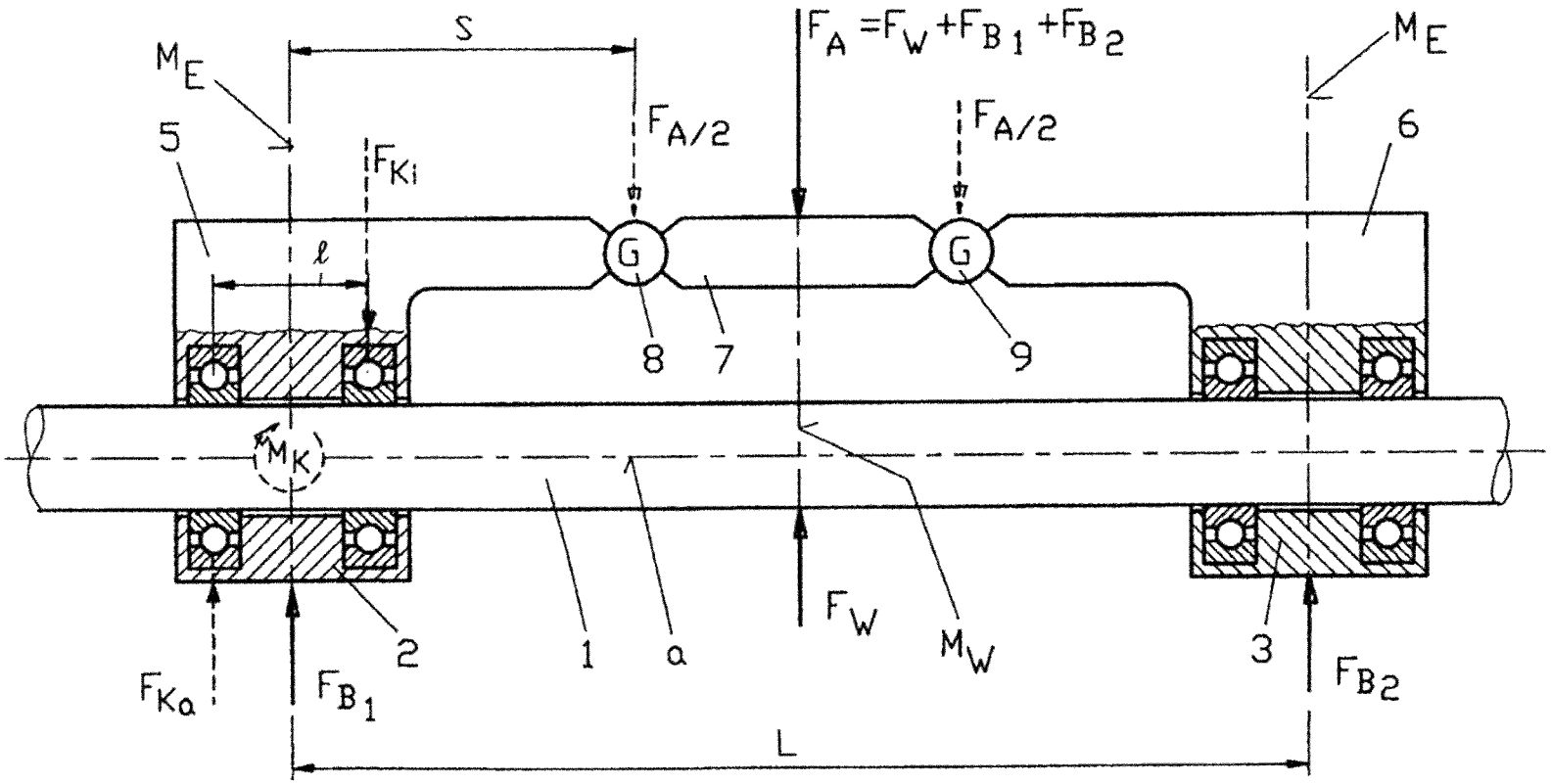
FIG. 4 shows a mechanical equivalent model for the apparatus of FIG. 1 with the forces and shape parameters specified.

The mode of action of the principle is described below based on a simplified arrangement, reference being made to FIG. 4.

Cylinder force $F_A$ acts centrally on the traverse 7 of the bending bridge that in addition to traverse 7 comprises the two bending levers 5 and 6, the connection between bending levers 5, 6 and traverse 7 being via the joints 8 and 9. Roll 1 is shown in simplified form as a round beam with a constant cross-section over its length and is loaded at the center by a concentrated force $F_W$ from the rolling process.

In this simplified representation, the system is in no way asymmetrical and completely counterbalanced, with the result that the balancing forces $F_{B1}$ and $F_{B2}$ compensating for the weight of the roll and its attachments equal zero. The bending levers 5, 6, and the roll chocks 2, 3 are combined into one body—a division into two components ultimately only provides an easier constructive design as required. Connection of the roll chock/bending bridge in this equivalent system is effected by simple fixed bearings, the relative spacing of which in the chock is l. The centers of the chocks (center planes $M_E$) have a center-to-center bearing spacing L, while the spacing of the joints 8, 9 from the respective centers of the chocks is S. The restoring compensation moment $M_K$ is determined by $$M_K = \tfrac{1}{2} \times F_W \times S$$

and where $F_{B1} = F_{B2} = 0$ by $$M_K = 1/2 \times F_A \times S$$

The bearing forces $F_{Ka}$ and $F_{Ki}$ (see FIG. 4, at left) are produced by $$F_{Ka} = \frac{F_A}{2}\left(\frac{S}{l} - \frac{1}{2}\right)$$

and $$F_{Ki} = \frac{F_A}{2}\left(\frac{S}{l} + \frac{1}{2}\right)$$

The by far greatest component of the deformation of a roll set in a stand under load is the deflection of the outer rolls (generally the backup rolls). Superimposing the roll deflection line due to rolling force $F_W = F_A$ and the roll deflection line due to the compensation moment $M_K$ yields the following function:

$$y = \frac{FL^3}{4EI}\frac{x}{L}\left[1/4\left(1 - 4/3\frac{x^2}{L^2}\right) - \frac{S}{L}\left(1 - \frac{x}{L}\right)\right]$$

for x<L/2 and with running coordinate x and deflection y.

E is the modulus of elasticity for the roll material; I is the geometric moment of inertia.

For a spacing S=0, the result is the known deflection line of a centrally loaded articulated support.

To highlight the compensation potential of the above-described passive and automatically-acting system, it is recommended that one view the relationship of the above-described deflection line with that which would result without the compensation mechanism, i.e.

$$\frac{y}{y_{uncompensated}} = 1 - 4\frac{S}{L}\frac{1 - \frac{x}{L}}{1 - \frac{4}{3}\frac{x^2}{L^2}}$$

Figure 5:
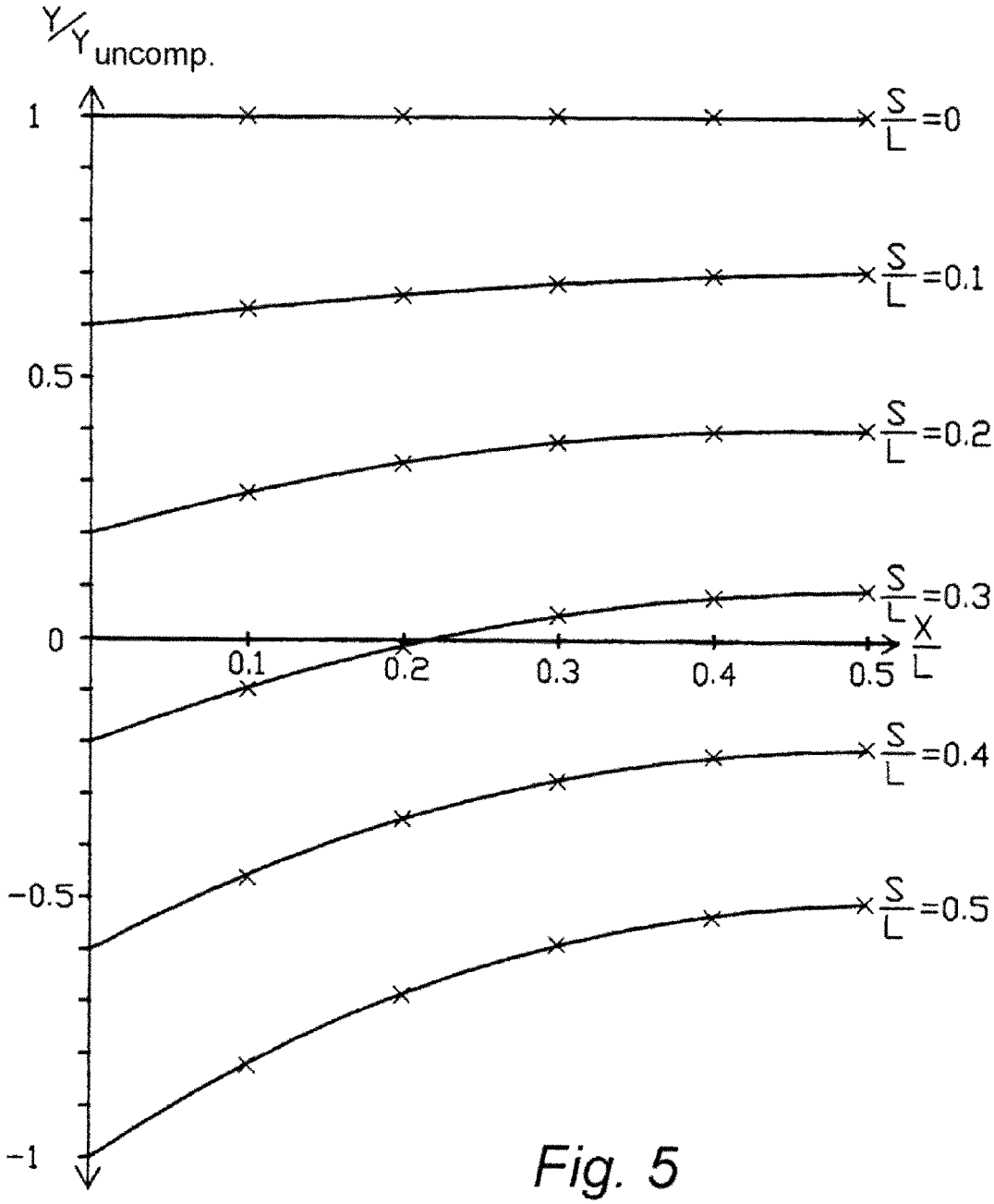
FIG. 5 shows a curve of the ratio $y/y_{uncorrected}$ over a ratio x/L for various values S/L.

In FIG. 5, this function is plotted against the spacing parameter S. The running coordinate x/L=0 describes the chock center (center bearing position, i.e. center plane $M_E$); x/L=0.5 denotes the center of the roll. S/L=0 means that the application of force by the actuator cylinder is effected at the center of the chock, i.e. without any bending effect. This state corresponds to a conventional roll stand. S/L=0.5 means that the bending lever has the maximum length, i.e. half the bearing center-to-center spacing and that therefore the reverse-bending moment is at its greatest level.

FIG. 5 shows for a simplified example that a significant compensation can be expected for bending lever lengths of around 30% of the bearing center-to-center spacing L. Other optimal lever lengths can be expected for real, that is, not intentionally idealized conditions (as in the example), such as, e.g. stepped-offset rolls; the principle however remains the same.

The above-mentioned descriptions and calculations demonstrate that a roll stand can be designed so as to be able to reduce the critical deformation components of the roll sets down to approximately 20% or less as compared to conventional stands without having for this purpose to provide active and mechanically costly and complicated control mechanisms.

In currently used four-high stands, it is typical to employ two active control mechanisms to modify the shape of the roll gap, specifically one work-roll bending system and one roll-displacement system. Both systems have a control travel of approximately equal size. If based on the above-described principle what occurs is only 20% of the fundamental roll set deformations, a significantly greater control range for controlling flatness remains for any still existing bending system as compared with a conventional stand in which bending must largely be used for the basic settings of the roll stand.

As a result, the system according to the invention is preferably employed in combination with the previously known systems for modifying the roll gap. This is true in particular for balancing cylinders for pivoting, for active control systems for bending the rolls, for roll-displacement systems, for roll crossing systems, and even for thermally operating systems.

The proposal according to the invention may of course be used in all types of roll stands, i.e. two-high, four-high, and six-high roll stands, as well as stands having lateral roll supports.

In addition, provision can be made in a further development whereby modifiably lever lengths S (i.e. locations of pivots G) can be used for active control.

The principal advantage, however, is that the invention provides a roll stand of simple construction having the capability of largely compensating the roll-force-induced deformations of the roll set automatically without external assistance and in a manner that is correctly dimensioned. Similar results would be achieved with a conventional design only with significantly thicker backup rolls or a complex and costly active flatness-correction system. For the above-described simplified example still having only 20% residual deformation as compared with the conventional stand of identical overall size, the roll would have to be more than 70% thicker in order to have work like the mechanism according to the invention. This would result in a huge enlargement of the stand along with corresponding additional costs.

The invention claimed is:

1. A roll stand through which a workpiece to be rolled passes in a travel direction, the roll stand comprising:

a frame having a pair of sides;

a roll centered on a roll axis extending between the sides of the frame and having a pair of axially opposite ends;

respective chocks vertically guided in the sides of the frame and in which the roll ends are journaled for rotation of the roll in the chocks about the roll axis, each of the chocks having a center plane perpendicular to the roll axis and parallel to the travel direction, the chocks being pivotal in the respective sides of the frame about respective chock axes lying in the plane and parallel to the travel direction;

respective bending levers fixed to the chocks for joint pivoting therewith about the respective chock axes and also vertically guided in the sides of the frame for joint pivoting of each lever and the respective chock about the respective chock axis; and a single actuator bearing on each of the bending levers at a location equispaced between the center planes and in a direction transverse to the roll axis for applying a torque to the levers and thereby countering a pressure applied by a workpiece to the roll by pivoting the chocks and the levers jointly about the respective chock axes.

2. The roll stand defined in claim 1 wherein each lever has an inner end provided with a pivot, the stand further comprising:

a traverse connected to the inner ends at the pivots, the single actuator bearing directly on the traverse and therethrough on the levers.

3. The roll stand defined in claim 2 wherein the roll axis is horizontal and each pivot defines a horizontal pivot axis lying in a plane perpendicular to the roll axis.

4. The roll stand defined in claim 1 further comprising:

formations between the levers and the respective chocks for limited shifting of the chocks in the respective levers substantially parallel to the roll axis.

5. The roll stand defined in claim 1 wherein the roll has at each of its ends an axially centered stub shaft, each lever having a pair of axially spaced radial-force bearings carrying the respective stub shafts and torsionally coupling the roll end to the respective lever.

6. The roll stand defined in claim 1 wherein the single actuator is a hydraulic piston/cylinder unit bearing vertically downward on the levers.

* * * * *